US006026672A

United States Patent [19]

Miller

[11] Patent Number: 6,026,672

[45] Date of Patent: Feb. 22, 2000

[54] WIRE DRAWING PRESSURE DIE HOLDER ASSEMBLY

[76] Inventor: Thomas L. Miller, 46 W. 168 Higgins Rd., Hampshire, Ill. 60140

[21] Appl. No.: 09/141,819

[22] Filed: Aug. 28, 1998

[51] Int. Cl.[7] ..... B21C 3/12; B21C 9/00

[52] U.S. Cl. ..... 72/467; 72/282; 72/41

[58] Field of Search ..... 72/41, 43, 467, 72/274, 282, 278

[56] References Cited

U.S. PATENT DOCUMENTS

| | | | |
|---|---|---|---|
| 678,789 | 7/1901 | McCool . | |
| 1,896,674 | 2/1933 | Longwell | 72/41 |
| 1,931,095 | 10/1933 | Todt . | |
| 2,028,652 | 1/1936 | De Mulatier | 72/467 |
| 2,088,040 | 7/1937 | Simons et al. . | |
| 2,188,470 | 1/1940 | Brandt . | |
| 2,252,365 | 8/1941 | Fisher | 72/43 |
| 2,360,746 | 10/1944 | Walker . | |
| 3,109,663 | 11/1963 | Ogillips, Jr. . | |
| 3,145,832 | 8/1964 | Case . | |
| 3,436,953 | 4/1969 | Hajikano . | |
| 3,526,115 | 9/1970 | Armstrong et al. . | |
| 3,740,990 | 6/1973 | Prajsnar et al. | 72/467 |
| 3,879,973 | 4/1975 | Godyn et al. | 72/41 |
| 3,937,053 | 2/1976 | Akamatsu | 72/352 |

FOREIGN PATENT DOCUMENTS

| | | | |
|---|---|---|---|
| 1018829 | 11/1957 | Germany | 72/467 |
| 3211171 | 7/1983 | Germany | 72/274 |
| 712158 | 1/1980 | U.S.S.R. | 72/467 |

*Primary Examiner*—Daniel C. Crane
*Attorney, Agent, or Firm*—Meroni & Meroni; Charles F. Meroni

[57] ABSTRACT

The inventive pressure die holder is comprised of an elongate hollow steel cylinder which receives a series of dies in an interior cavity. The dies are maintained within the cavity by means of a cap which is attached to one end of the pressure die holder. The inventive pressure die holder is provided with two sets of vents which relieve lubricant pressure within the pressure die holder. The first set of vents are located in mid portion of the body of the pressure die holder in alignment with the dies. The first set of vents reduce pressure between the die pair, allowing the lubricant to flow through the die at a cooler temperature. The second set of vents are located in the body of the pressure die holder adjacent the cap, and allow the cap to be removed from the pressure die holder at the end of the drawing operation.

19 Claims, 2 Drawing Sheets

WIRE DRAWING PRESSURE DIE HOLDER ASSEMBLY

BACKGROUND OF THE INVENTION

This invention relates to a die assembly for the cold drawing of wire and/or bar stock. Specifically, this invention relates to a pressure die holder assembly having venting means to decrease lubricant pressure within the pressure die holder.

Competitive pressures among wire manufactures has lead to increases in wire drawing speeds. In order to draw at high speeds, many wire manufactures use pressure applications to help increase wire lubrication and decrease temperatures. In the wire drawing process, it is common practice to continuously draw the wire stock through a die assembly which includes a pressure die, which forces lubricant under high pressure onto the wire surface, followed by a drawing die, which reduces the diameter of the wire. Forcing lubricant through the dies with the wire allows the die to run at much cooler temperatures while maintaining consistent lubricant residuals. Pressure die systems allow manufacturers to increase production without dramatically increasing die wear.

The pressure die holder which is now commonly used employs an elongate hollow cylindrical body, bisected lengthwise, which receives the two dies and holds them in series during the wire drawing process. The drawback with using this type of die holder is that the proper axial alignment of the dies difficult to maintain as the pressure between the dies becomes great.

U.S. Pat. No. 5,402,664 to Sarver et al discloses a cylindrical die holder for holding a pair of dies in axial alignment. A cap portion is threaded onto a body portion. This invention requires the use of specially designed dies rather than standard stock dies, and employs no pressure relief venting of the lubricant.

SUMMARY OF THE INVENTION

The inventive pressure die holder is comprised of an elongate hollow steel cylinder which receives a series of dies in an interior cavity. The dies are maintained within the cavity by means of a cap which is attached to one end of the pressure die holder. The inventive pressure die holder is provided with two sets of vents which relieve lubricant pressure within the pressure die holder.

The first set of vents are located in mid portion of the body of the pressure die holder in alignment with the dies. The first set of vents reduce pressure between the die pair, allowing the lubricant to flow through the die at a cooler temperature.

The second set of vents are located in the body of the pressure die holder adjacent the cap, and allow the cap to be removed from the pressure die holder at the end of the drawing operation.

It is an object of this invention to provide a pressure die holder which allows wire to be drawn through the die system at much higher rates while simultaneously decreasing internal die temperature. In practice, the inventive pressure die holder increased line speed by 50 feet per minute with a simultaneous die temperature decrease of 20 degrees over the conventional pressure die holder. Due to decreased die temperatures, the resulting wire product has improved quality and more consistent tensile properties.

It is an object of this invention to provide a pressure die holder which can be fabricated in various sizes so as to produce wire ranging from 0.002 to 0.400 inches in diameter.

It is an object of this invention to provide a pressure die holder which has a cap portion which can be easily removed from the body portion after the wire drawing process has been concluded. Pressure relief vents are provided in the region of the cap attachment means, preventing the high pressure melting and subsequent hardening of the cooled lubricant within the attachment means.

DESCRIPTION OF THE INVENTION

Figure 1:
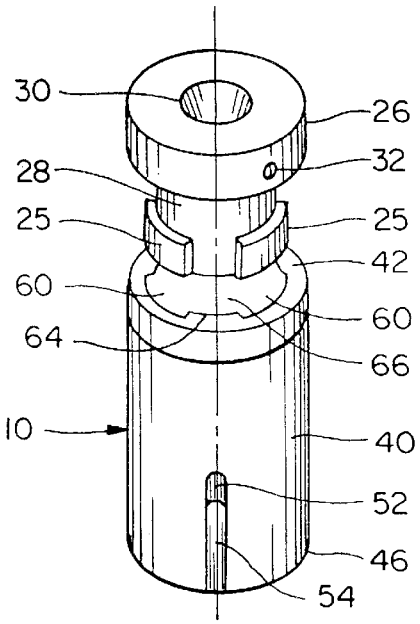
FIG. 1 Exploded side perspective view of the pressure die holder showing the cap portion and the body portion.
Figure 2:
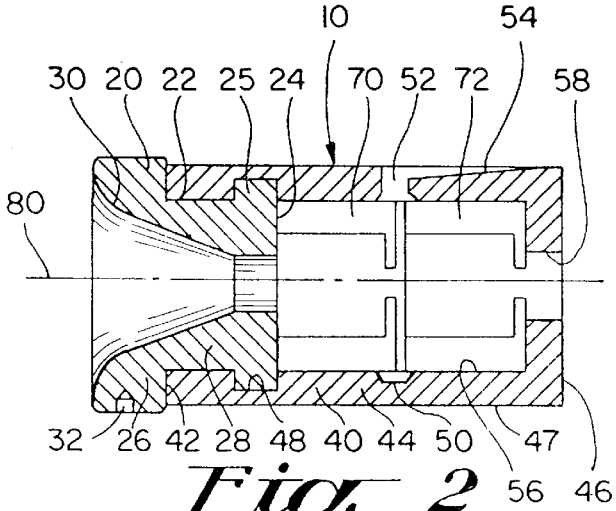
FIG. 2 Side sectional view of the assembled pressure die holder with two wire reducing dies in place.

Referring to FIGS. 1 and 2, the pressure die holder 10 is a generally elongate cylinder and is made up of two components, a cap portion 20 and a body portion 40.

The body portion 40 has a first end 42, a mid portion 44, and a second end 46. A first axial bore 56 is provided in the body portion 40 extending from the first end 42 through the mid portion 44. The first axial bore 56 forms the interior space of the body portion 40 and provides a structure for maintaining two wire diameter-reducing dies 70, 72 in a longitudinally aligned sequential arrangement. A second axial bore 58 is provided in the body portion 40 extending from the second end 46. The second axial bore 58 is aligned with the first axial bore 56, but is of smaller diameter than the first axial bore 56. The second axial bore 58 communicates with the interior space and provides a means for the drawn wire to exit the pressure die holder 10. The exterior surface 47 of the body portion 40 is slightly tapered from the first end 42 to the second end 46. In the preferred embodiment, this taper is two degrees and will allow the pressure die holder 10 to be received in standard die boxes.

The cap portion 20 is comprised of a head 26 and a neck 28. The head 26 has the same diameter as the first end 42 of the body portion 40. The neck 28 has a first end 22 which extends integrally from the head 26 and a second end 24 which is opposed to the first end 22. The neck 28 has a diameter which is approximately that of the first axial bore 56 so that the neck 28 is completely received within the first axial bore 56 such that the head 26 lies adjacent to the first end 42 of the body portion. The cap portion 20 is provided with an axial bore 30 which extends through the length of the cap portion 20. The axial bore 30 within the cap portion 20 has a large diameter at the head 26, the diameter of the axial bore 30 tapering to a smaller diameter at the second end 24 of the neck. A single shallow, radially oriented recess 32 is provided in the head 26 of the cap portion 20 to receive a spanner wrench.

Figure 3:
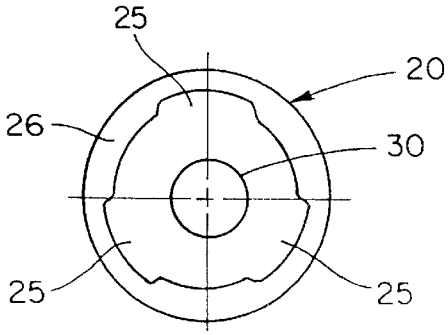
FIG. 3 End view of the cap of the pressure die holder showing the three radially extending flanges.

The second end 24 of the neck 28 is provided with at least one flange 25 which extends radially outward. This flange 25 is generally rectangular in shape and extends longitudinally along the neck 28. The flange 25 may extend longitudinally from the second end 24 to approximately one third of the length of the neck 28. Thus the flange 25 is substantial and should not be confused with a screw thread. In the preferred embodiment, there are three flanges 25 extending radially outward from and spaced equidistantly about the second end 24 of the neck 28 (FIG.3). It should be noted that variations in the number, size, and shape of the flanges 25 are within the scope of this invention. The number, size and shape disclosed in the preferred embodiment are designed to maintain the cap portion 20 adjacent to the body portion 40 when the pressure die holder 10 is experiencing high internal pressure.

The first end 42 of the body portion 40 is provided with at least one, preferrably three, longitudinal channels 60 formed in the interior wall 66 (FIG. 1). The longitudinal channels 60 are spaced equidistantly about the interior wall 66 of the body portion 40. The structural portions of the first end 42 which remain between the longitudinal channels 60 will be referred to as ridges 64.

The body portion 40 is also provided with a first circumferential channel 48 which is formed on the interior wall 66 near to, but spaced from, the first end 42. The three longitudinal channels 60 extend between and provide communication between the first end 42 of the body portion 40 and the first circumferential channel 48. The three longitudinal channels 60 and the first circumferential channel 48 are sized to receive the flanges 25 which extend from the neck 28 of the cap portion 20.

The cap portion 20 is maintained on the body portion 40 in the following manner: The neck 28 of the cap portion 20 is inserted into the body portion 40 such that each of the flanges 25 pass through a corresponding longitudinal channel 60 until the head 26 of the cap portion 20 abuts the first end 42 of the body portion 40, the neck 28 is entirely received within the first bore 56, and the flanges 25 reside within the first circumferential channel 48. The cap portion 20 is rotated about the longitudinal axis 80 until the flanges rest behind the ridges 64. The ridges 64 provide a means to prevent the longitudinal retraction of the cap portion 20 from the body portion 40. A stop pin (not shown) is provided in the first circumferential channel which limits the rotation of the cap portion to approximately one-quarter turn so as to allow easy and accurate longitudinal alignment of the flanges 25 and ridges 64.

In use, the pressure die holder 10 is assembled by placing two wire reducing dies 70, 72 within the first axial bore 56 and then applying the cap portion 20 to the body portion 40. The diameter of the first axial bore 56 is sized to fittingly receive the dies 70, 72 so that they are maintained in axial alignment. The dies 70, 72 abut the interior aspect of the second end 46 of the body portion 40 and are longitudinally maintained within the first axial bore 56 by abutment against the second end 24 of the neck 28. If a more snug longitudinal fit is required, a belleville washer (not shown) can be placed in the first axial bore 56 between the dies 70, 72 and the second end 24 of the neck 28.

The body portion 40 is provided with two sets of venting means to relieve lubricant pressure within the pressure die holder during the wire drawing process.

The first set of venting means is located in the mid portion 44 of the body portion 40 and is comprised of at least one transverse venting bore 52 which extends radially through the body portion 40 to provide communication with the interior space and the atmosphere. More specifically, the first set of venting means is aligned with a first transverse plane defined by the abutting surfaces of the dies 70,72. A shallow longitudinal channel is formed in the exterior surface 47 of the body portion 40 to form a vent line 54 between the venting bore 52 and the second end 46 of the body portion 40. In the preferred embodiment, there are three transverse venting bores 52 which lie in the first transverse plane. The transverse venting bores 52 are placed equidistantly about the circumference of the body portion 40. Each transverse venting bore 52 is provided with a vent line 54. Additionally, a second circumferential channel 50 is formed on the interior wall 66 of body portion 40 which is in alignment with the first transverse plane. The second circumferential channel 50 provides interior communication between the venting bores 52 when the dies 70,72 are located within the first axial bore 56.

Figure 5:
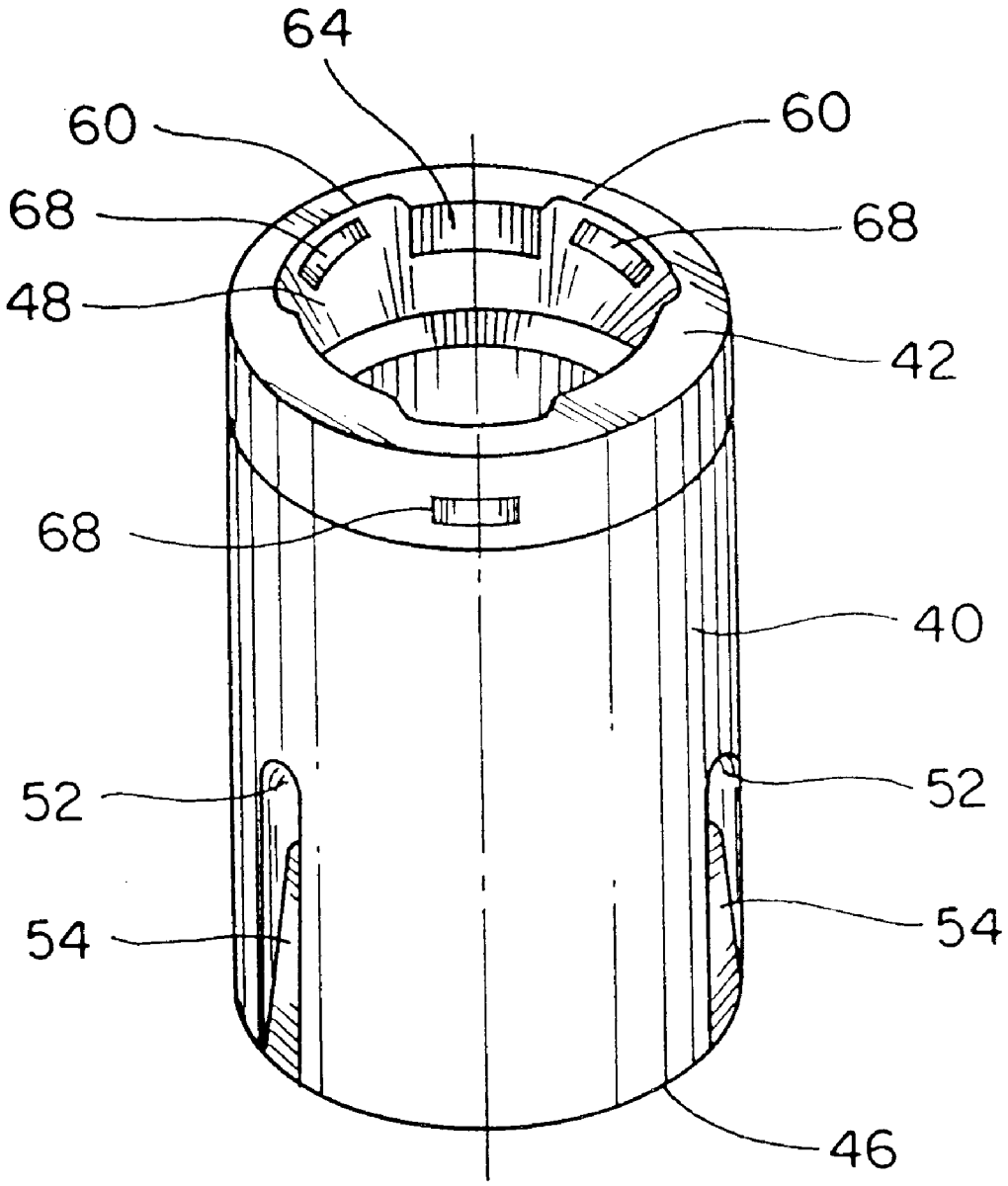
FIG. 5 Side perspective view of the body portion of the pressure die holder showing the first and second sets of venting means.

The second set of venting means is provided near the first end 42 of the body portion 40 and is comprised of at least one transverse venting slot 68 (FIG. 5). The venting slot 68 extends radially through the body portion 40 to provide communication between a longitudinal channel 60 and the atmosphere. In the preferred embodiment there are three venting slots 68. It should be noted that when the cap portion 20 is in place on the body portion 40, and the flanges 25 have been rotated in the first circumferential channel 48 so that the flanges 25 and the ridges 64 are in longitudinal alignment, a vacant space is provided within the longitudinal channels 60 between the head 26 of the cap portion 20 and the dies 70,72. During the wire drawing process, high internal lubricant pressures cause lubricant to back flow into this vacant space. By providing pressure relief venting in this space, the lubricant is prevented from melting within this space. This, in turn, prevents the lubricant from subsequently cooling and hardening within the channel 60, which would prevent removal of the cap portion 20.

Figure 4:
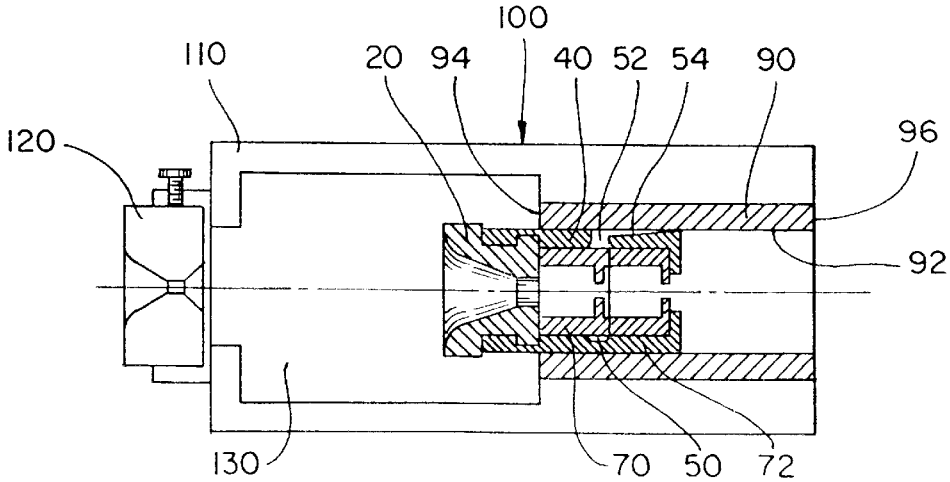
FIG. 4 Side sectional view of the pressure die holder within the die box showing the relationship between the pressure die holder and the steel sleeve of the die box.

FIG. 4 shows the pressure die holder 10 within a die box 100. The pressure die holder 10 is maintained within the die box 10 by placement within a steel sleeve 90. The interior surface 92 of the steel sleeve 90 is tapered to snugly receive the tapered exterior surface 47 of the body portion 40. However, the body portion 40 does not reside completely within the steel sleeve 90. Specifically, the mid portion 44 and second end 46 are received within the steel sleeve 90 while the first end 42 and venting slots 68 remain outside the steel sleeve 90. Thus, the venting slots 68 allow lubricant to be released from the longitudinal channels 60 into the interior of the die box 100. Venting lines 54 are provided between the body portion 40 and the steel sleeve 90 so that the venting bores 52 can allow lubricant to be released from the second circumferential channel 50 out of the die box 100. Wire is brought into the die box 100 through guide die 120 and travels through a soap powder bath 130 within the die box 100. Soap powder and the wire travels through the tapered bore 30 within the cap portion 20 and then through the wire reducing dies 70, 72 within the body portion 40.

In the preferred embodiment, the pressure die holder 10 will be formed from 4140 steel, but it is within the scope of this invention to form it from other materials which can provide the necessary mechanical properties.

In the preferred embodiment, the assembled pressure die holder 10 will have a length of 3.92 inches and an outer diameter of 2.15 inches at the first end 42, the outer diameter tapering 1.5 degrees from the mid portion 44 to the second end 46. The first 56 and second 58 axial bores will be of 1.51 inch and 0.63 inch diameters, respectively. The cap portion 20 has a total length of 1.57 inches, the head 26 and neck 28 having 0.61 inch and 0.96 inch lengths, respectively. The preferred embodiment pressure die holder can receive dies which produce wire diameters of 0.008 inches to 0.300 inches. However, it is within the scope of this invention to form the pressure die holder in larger and smaller sizes so as to accommodate dies which produce wire of larger and smaller diameter.

Venting bores 52, which relieve lubricant pressure at the interface between the two dies 70, 72, are provided in one of three different venting bore diameters in the preferred embodiment. Selection of a specific vent bore diameter is dependent upon the amount of lubrication required for a given application. In general, a faster wire drawing speed requires more lubrication and therefore a smaller venting bore diameter. The venting bore 52 is provided in ⅛ inch, ¼ inch, or ⅜ inch diameters. In general, a ⅛ inch diameter venting bore would be used for wire speeds of 4000 ft per minute or faster, a ¼ inch diameter venting bore would be used for wire speeds of 1000 to 4000 feet per minute, and a ⅜ inch diameter venting bore would be used for wire speeds less than 1000 feet per minute. However, it is within the scope of this invention to provide a pressure die holder 10 with venting bore diameters which are larger or smaller than those described above.

While a single specific embodiment of the invention has been shown and described herein, the same is merely illustrative of the principles of the invention and other forms may be resorted to within the scope of the appended claims.

I claim:

1. A pressure die holder assembly for holding dies during a wire drawing process, the assembly being a generally elongate cylinder in shape and comprising a cap portion and a body portion, wherein the cap portion comprises a head, a neck extending from said head, and an axially aligned bore which extends completely through the cap portion, the body portion comprises a first end, a mid portion, and a second end, an outer surface, and a longitudinal axis, the body portion comprising a first bore, the first bore having a first diameter and extending axially from said first end providing an opening within the body sized for receiving dies and for receiving the neck of the cap portion, the first bore further providing an inner surface of the body portion, the body portion comprising a second bore having a second diameter extending axially from said second end providing an opening sized to allow passage of wire from the body portion, said first and second bores in communication with each other, the body portion comprising at least one venting bore located in the mid portion of the body portion, said venting bore comprising a vent hole which extends transversely between the first bore and the outer surface of the body portion, the venting bore also comprising a channel in the outer surface of the body portion extending longitudinally from the vent hole to said second end such that said channel provides a means of fluid communication between said vent hole and said second end.

2. The pressure die holder of claim 1 wherein the body portion further comprises at least one venting slot located adjacent said first end which extends transversely from the first bore to the outer surface of the body portion such that communication is provided between the first bore and the outer surface.

3. The pressure die holder of claim 2 wherein the neck of the cap portion has a neck diameter, said neck diameter being the same as said first diameter and said neck diameter being smaller than the diameter of the head, wherein the neck is comprised of a first end which integrally extends from said head and a second end which is opposed to said first end, wherein said second end of the neck is provided with at least one radially extending flange, and wherein said body portion is provided with a circumferential channel in the inner surface of the body portion, said circumferential channel being spaced from said first end of the body portion, and wherein at least one longitudinal channel is provided in the inner surface of the body portion, said longitudinal channel extending between said first end and said circumferential channel, said circumferential and longitudinal channels being sized to received said radially extending flange, such that the longitudinal channel allows the flange to pass into the body portion where it resides in the circumferential channel.

4. The pressure die holder of claim 3 wherein the second end of the neck is provided with three radially extending flanges which are equidistantly spaced about the circumference of the neck, and wherein the body portion is provided with three longitudinal channels which are equidistantly spaced about the circumference of the body portion and which extend between said first end and said circumferential channel, said three longitudinal channels allowing passage of said three radially extending flanges into said circumferential channel.

5. The pressure die holder of claim 4 wherein the body portion comprises three venting bores.

6. The pressure die holder of claim 5 wherein the body portion comprises a second circumferential channel provided in the inner surface of the body portion, said second circumferential channel intersecting the three venting bores.

7. The pressure die holder of claim 6 wherein the axially aligned bore of the cap portion has a large diameter at the head and tapers to a smaller diameter as it extends to the second end of the neck portion.

8. A pressure die assembly for drawing wire at high speeds, the assembly comprising a die box, a pressure die holder, and two dies, said dies being housed within and maintained in axial alignment by said pressure die holder, said pressure die holder being housed within a die box, wherein each of said two dies has a body portion, the body portion having opposing end surfaces, the die box is comprised of a steel sleeve, and the pressure die holder is comprised of a body and a cap, said body having a first end, a mid portion, a second end, and an exterior surface, said cap being maintained on the first end of the body by an attachment means, wherein the pressure die holder is fittingly received within the steel sleeve, the body of the pressure die holder comprising an axial bore which extends from said first end through the mid portion, terminating adjacent the second end, said axial bore forming an interior space which has a diameter sized to fittingly receive said dies, said dies maintained in close serial adjacency within the interior space by abutment against said attachment means at said first end and by abutment against the body at said second end, wherein said close serial adjacency of said dies causes an end surface of one of the dies to abut an end surface of the remaining die, the body further comprising at least one first radial bore which provides communication between said interior space and the exterior surface of the body, said first radial bore located in the mid portion of the body such that the first radial bore is aligned with a transverse plane defined by the abutting end surfaces of the two dies, said first radial bore intersecting a longitudinal channel formed in the exterior surface of the body, said longitudinal channel extending from said first radial bore to said second end, said channel providing a vent line between the exterior surface of the pressure die holder and the steel sleeve.

9. The assembly of claim 8 wherein the body comprises three first radial bores which provide communication between said interior space and the exterior surface of the body, the three first radial bores being located in the mid portion of the body such that each of the first radial bores are aligned with a transverse plane defined by the abutting surfaces of the two dies.

10. The assembly of claim 9 wherein a circumferential channel is provided in the axial bore of the body, said circumferential channel intersecting the three venting bores and providing communication between the three venting bores.

11. The assembly of claim 10 wherein cap comprises a head and a neck extending from said head, wherein the neck is comprised of a first end which integrally extends from said head and a second end which is opposed to said first end, wherein said second end of the neck is provided with at least one radially extending flange, and wherein the body is provided with a second circumferential channel in the axial bore, said second circumferential channel being adjacent to and spaced from said first end of the body, and wherein at least one longitudinal channel is provided in the axial bore, said longitudinal channel extending between said first end and said second circumferential channel, said second circumferential and longitudinal channels being sized to received said radially extending flange, such that the longitudinal channel allows the flange to pass into the body portion where it resides in the second circumferential channel, and wherein said body comprises at least one second radial bore which extends between said interior space and the exterior surface of the body to provide communication between a longitudinal channel and the atmosphere.

12. The assembly of claim 11 wherein the neck is provided with three radially extending flanges which are equidistantly spaced about the circumference of the neck, and wherein the body is provided with three longitudinal channels which are equidistantly spaced about thecircumference of the body portion and extend between said first end and said second circumferential channel, said longitudinal channels allowing passage of said flanges into said circumferential channel, and further wherein each of said longitudinal channels is provided with a second radial bore.

13. The assembly of claim 12 wherein the attachment means comprises the ridges on the interior walls of the axial bore between the three longitudinal channels which were formed as a result of the formation of said longitudinal channels, said ridges providing a longitudinal stop for the three radially extending flanges when the second end of the neck is inserted into the axial bore concurrent with the three radially extending flanges passing through the three longitudinal channels until said radially extending flanges reside within the second circumferential channel, after which the cap is axially rotated allowing the flanges to rotate to a position wherein they are longitudinally aligned with the ridges such that the cap is maintained axially adjacent to said body.

14. The assembly of claim 13 wherein the steel sleeve comprises a first end and a second end and an interior surface, and wherein the interior surface is provided with a tapering diameter from said first end to said second end, and wherein said exterior surface of the pressure die holder is provided with a matching taper so as to reside within the steel sleeve in a fitted, non-spaced adjacency.

15. A pressure die holder assembly for holding dies during a wire drawing process, the assembly being a generally elongate cylinder in shape and comprising a cap portion and a body portion, wherein the cap portion comprises a head, a neck extending from said head, and an axially aligned bore which extends completely through the cap portion, the body portion comprises a first end, a mid portion, and a second end, an outer surface, and a longitudinal axis, the body portion comprising a first bore, the first bore having a first diameter and extending axially from said first end providing an opening within the body sized for receiving dies and for receiving the neck of the cap portion, the first bore further providing an inner surface of the body portion, the body portion comprising a second bore having a second diameter extending axially from said second end providing an opening sized to allow passage of wire from the body portion, said first and second bores in communication with each other, the body portion comprising at least one venting bore located in the mid portion of the body portion, said venting bore comprising a vent hole which extends transversely between the first bore and the outer surface of the body portion, the venting bore also comprising a channel in the outer surface of the body portion extending longitudinally from the vent hole to said second end such that said channel provides a means of fluid communication between said vent hole and said second end, wherein the body portion further comprises at least one venting slot located adjacent said first end which extends transversely from the first bore to the outer surface of the body portion such that communication is provided between the first bore and the outer surface, wherein the neck of the cap portion has a neck diameter, said neck diameter being the same as said first diameter of said neck diameter being smaller than the diameter of the head, wherein the neck is comprised of a first end which integrally extends from said head and a second end which is opposed to said first end, wherein said second end of the neck is provided with at least one radially extending flange, and wherein said body portion is provided with a circumferential channel in the inner surface of the body portion, said circumferential channel being spaced from said first end of the body portion, and wherein at least one longitudinal channel is provided in the inner surface of the body portion, said longitudinal channel extending between said first end and said circumferential channel, said circumferential and longitudinal channels being sized to received said radially extending flange, such that the longitudinal channel allows the flange to pass into the body portion where it resides in the circumferential channel.

16. The pressure die holder of claim 15 wherein the second end of the neck is provided with three radially extending flanges which are equidistantly spaced about the circumference of the neck, and wherein the body portion is provided with three longitudinal channels which are equidistantly spaced about the circumference of the body portion and which extend between said first end and said circumferential channel, said three longitudinal channels allowing passage of said three radially extending flanges into said circumferential channel.

17. The pressure die holder of claim 16 wherein the body portion comprises three venting bores.

18. The pressure die holder of claim 17 wherein the body portion comprises a second circumferential channel provided in the inner surface of the body portion, said second circumferential channel intersecting the three venting bores.

19. The pressure die holder of claim 18 wherein the axially aligned bore of the cap portion has a large diameter at the head and tapers to a smaller diameter as it extends to the second end of the neck portion.

* * * * *